US005827808A

United States Patent [19]

Appleby et al.

[11] Patent Number: 5,827,808

[45] Date of Patent: Oct. 27, 1998

[54] DISHWASHING METHOD

[75] Inventors: Claire Appleby, Monkseaton; Graeme Duncan Cruickshank, Forest Hall; Lynda Anne Jones, Gosforth, all of England

[73] Assignee: The Procter & Gamble Company, Cincinnati, Ohio

[21] Appl. No.: 792,200

[22] Filed: Jan. 31, 1997

[51] Int. Cl.[6] ..... C11D 7/18

[52] U.S. Cl. ..... 510/220; 510/228; 510/375; 510/471; 510/473; 510/508

[58] Field of Search ..... 510/220–233, 510/473

[56] References Cited

U.S. PATENT DOCUMENTS

| | | | |
|---|---|---|---|
| 3,869,412 | 3/1975 | Waag | 252/527 |
| 4,115,292 | 9/1978 | Richardson et al. | 510/473 X |
| 4,576,744 | 3/1986 | Edwards et al. | 252/554 |
| 4,965,012 | 10/1990 | Olsen | 510/473 X |
| 5,510,052 | 4/1996 | McCandish | 252/174.12 |
| 5,520,835 | 5/1996 | Sivik et al. | 252/102 |
| 5,629,278 | 5/1997 | Baeck et al. | 510/236 |

FOREIGN PATENT DOCUMENTS

| | | | |
|---|---|---|---|
| 0 096 680 | 12/1983 | European Pat. Off. | C11D 3/22 |
| 0 374 017 | 6/1990 | European Pat. Off. | C01B 33/32 |
| 5-78698 | 3/1993 | Japan | C11D 17/00 |

OTHER PUBLICATIONS

Derwent WPI Accession No. 93–140545/17 of JP 5078698 Mar. 1993.

Derwent WPI Accession No. 83–33658K/14 of JP 58034900 Mar. 1983.

Grant and Grant, Grant & Hackh's Chemical Dictionary, 4th edition, p. 121, 1969.

*Primary Examiner*—Margaret Einsmann

*Attorney, Agent, or Firm*—Jacobus C. Rasser; Ken K. Patel; Pankaj M. Khosla

[57] ABSTRACT

There is provided the use of a cellulose ether material to inhibit the transfer of a colored food soil from an aqueous wash solution to a substrate in a dishwashing method.

25 Claims, No Drawings

DISHWASHING METHOD

TECHNICAL FIELD

The present invention relates to the use of cellulose ether material for inhibiting the transfer of coloured food soils in a dishwashing method.

BACKGROUND OF THE INVENTION

A well recognised problem arising during modern fabric laundering operations is the tendency of some coloured fabrics to release dye into the laundry wash solution. The dye is then transferred onto other fabrics being washed therewith.

In dishwashing, especially machine dishwashing methods, there exists a related problem, which is however, not widely recognised in the art. Coloured food soils, comprising natural dyestuffs, may be removed from soiled articles into the wash solution, and then may be redeposited from the wash solution onto other articles in the wash or onto the interior of the dishwashing machine.

The problem is particularly noticeable when the washload includes articles soiled by foods naturally containing significant levels of coloured dyestuff molecules, including for example tea, fruit juice and coloured vegetable soils, such as carotenoid soils.

EP-A-0692 947 describes a dye transfer inhibiting composition for use in a machine dishwashing method. The composition comprises an enzymatic system capable of generating hydrogen peroxide in combination with certain metallo catalysts.

GB 2 285 629A describes the use of diacyl and tetraacyl peroxide bleaching species to inhibit the transfer of bleachable food soils from an aqueous wash solution to a substrate in a dishwashing method.

Hence, the problem underlying the present invention is the inhibition of the transfer of dye from coloured food soils, in an aqueous wash solution, to a substrate in a dishwashing method.

The inhibition of transfer of coloured food soils can be achieved in a number of different ways, for example, bleaching, chelation or dispersion of the coloured food soils. The present invention does not employ any of the above mechanism to inhibit dye transfer, but instead employs a barrier layer.

The Applicant has found that plastic articles in the wash, and areas of the interior of the dishwashing machine which are made of plastic material, are particularly susceptible to the deposition of coloured food soils from the wash solution. Said soils can interact with the surface of such plastic substrates producing staining which can be very difficult to remove.

The Applicant has now found that cellulose ether materials may be used to inhibit the transfer of coloured food soils when employed in a dishwashing, especially machine dishwashing, method. The use of a cellulose ether material for this purpose has not been disclosed in any of the aforementioned prior art documents.

SUMMARY OF THE INVENTION

According to the present invention there is provided the use of a cellulose ether material to inhibit the transfer of a coloured food soil from an aqueous wash solution to a substrate in a dishwashing method.

DETAILED DESCRIPTION OF THE INVENTION

According to the present invention a cellulose ether material is used to inhibit the transfer of dye from coloured food soils, in an aqueous wash solution, to a substrate in a dishwashing method.

Cellulose Ether Material

The polysaccharide cellulose ether material can be selected from the group having the general formula as shown below.

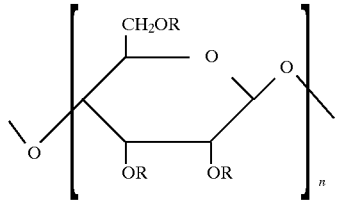

R is either hydrogen, an alkyl or carboxy alkyl group n is between 100 and 10 000.

The cellulose ether is preferably methyl cellulose, where R is $CH_3$, or carboxy methyl cellulose, where R is $CH_2COO—Na^+$. The cellulose ether has a degree of substitution of between 0.0 and 3.0, preferably between 0.5 and 2.5 and a molecular weight of between 20 000 and 150 000. According to the present invention the cellulose ether material has a degree of polymerisation of more than 100, preferably between 100 and 10 000. As used herein, the term 'degree of polymerisation (dp)' is the ratio of the weight average molecular weight to average molecular unit weight, i.e. $dp=MW_w/MUW$. The weight average molecular weight (MWW) is obtained by standard analytical methods as described in Polymer handbooks. A preferred method is light scattering from polymer solutions as originally defined by Debye.

For example, the average molecular unit weight (MUW) for methyl cellulose ether may be determined from the sum of the molecular weight of the unsubstituted cellulose unit and the product of the degree of polymerisation and the molecular weight of the substituent less the hydrogen mass (1).

i.e. MUW=162+(15−1)*ds—for methyl substituents found in methyl cellulose ethers.

MUW may also be determined form the "% methoxyl content" value (mc) also used by manufactures of methyl cellulose ethers instead of the degree of substitution, such that;

$$MUW=100-[(\text{mol.wt. of } CH_2/\text{mol.wt. of } OCH_3)*mc]$$

The cellulose ether materials in themselves have been found to be of particular utility in the dye transfer inhibition of carotenoid soils.

Coloured food soil transfer inhibition

The inhibition of the transfer of coloured food soils from an aqueous wash solution to a substrate surface is attained by the inclusion of a cellulose ether material in the wash solution.

It is believed that the cellulose ether material adheres to the surface of the tableware. It is further believed that the cellulose ether material inhibits the transfer of coloured food soils from the wash solution to the surface of the tableware, by providing a barrier layer which coats the surface of the tableware. Coloured soils are thus believed to adhere to the cellulose ether barrier layer and not the underlying tableware. The cellulose ether barrier layer and coloured food soil are removed during the washing process.

By coloured food soils it is meant essentially any food soils which are highly coloured and which dye may transfer to the substrate surface. The present invention is most especially concerned with the prevention of transfer of hydrophobic food soils, particularly those having carotenoid chromophores, such as beta-carotene, lycopene, zeaxanthin or capsanthin, hereinafter referred to generically as carotenoid soils. Carotenoid soils can be derived from carrots and tomatoes, and any processed products containing these components as well as certain tropical fruits and saffron.

The Applicant has found that the substrate material which is most prone to receipt of the transfer of coloured food soils is plastic material, such as polypropylene, polyethylene, polystyrene (including alkyl butyl styrene) or PVC. Such plastic substrate material may interact with any coloured food soils on the substrate surface to produce persistent staining of the substrate. This staining is particularly visible on translucent plastic material, as is commonly employed for food storage boxes and tubs.

Dishwashing method

The dishwashing method may be essentially any conventional dishwashing method. Preferably the dishwashing method is a machine dishwashing method performed using a dishwasher machine, which may be selected from any of those commonly available on the market.

The machine dishwashing method typically involves treating soiled tableware, such as crockery, glassware, hollowware and cutlery, with an aqueous wash solution having dissolved or dispersed therein an effective amount of a detergent composition. The cellulose ether materials are preferably present as components of a detergent composition.

By an effective amount of detergent composition it is generally meant from 5 g to 60 g of detergent composition per wash, dissolved or dispersed in an aqueous wash solution volume of from 3 to 10 liters, to provide a wash solution concentration of the detergent composition of from 0.05% to 2% by weight. The wash temperature may be in the range 40° C. to 65° C. as commonly is employed in such methods.

The cellulose ether materials can be present in the aqueous wash solution at a level of between 0.0001% and 0.1%, preferably 0.0005% to 0.01%, most preferably 0.001% to 0.005% by weight of wash solution.

Detergent Compositions

The cellulose ether materials are preferably present as components of a detergent composition. The detergent composition may contain various components including surfactants, detergent builders, alkalinity sources, other bleaching agents, lime soap dispersants, crystal growth inhibitors, heavy metal ion sequestrants, enzymes and enzyme stabilisers, corrosion inhibitors, suds suppressors, solvents, and hydrotropes.

Surfactant

A highly preferred component of the compositions employed in this invention is a surfactant system comprising surfactant selected from anionic, cationic, non-ionic ampholytic and zwitterionic surfactants and mixtures thereof. Automatic dishwashing machine products should be low foaming in character and thus the foaming of the surfactant system must be suppressed or more preferably be low foaming, typically non-ionic in character. The surfactant system is typically present at a level of from 0.2% to 30% by weight, more preferably from 0.5% to 10% by weight, most preferably from 1% to 5% by weight of the compositions.

A typical listing of anionic, non-ionic, ampholytic and zwitterionic classes, and species of these surfactants, is given in U.S. Pat. No. 3,929,678issued to Laughlin and Heuring on Dec. 30, 1975. A list of suitable cationic surfactants is given in U.S. Pat. No. 4,259,217 issued to Murphy on Mar. 31,1981. A listing of surfactants typically included in automatic dishwashing detergent compositions is given for example, in EP-A-0414 549 and PCT Applications Nos. WO 93/08876 and WO 93/08874.

Non-ionic surfactant

Essentially any non-ionic surfactants useful for detersive purposes can be included in the compositions. Preferred, non-limiting classes of useful non-ionic surfactants are listed below.

Non-ionic ethoxylated alcohol surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22carbon atoms. Particularly preferred are the condensation products of alcohols having an alkyl group containing from 8 to 20 carbon atoms with from about 2 to about 10 moles of ethylene oxide per mole of 10 alcohol.

Non-ionic ethoxylated/propoxylated fatty alcohol surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Non-ionic EO/PO condensates with propylene glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

Non-ionic EO condensation products with propylene oxide/ethylene diamine adducts The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of non-ionic surfactant include certain of the commercially available Tetronic• compounds, marketed by BASF.

Oxygen-releasing bleaching system

A preferred feature of the compositions is an oxygen-releasing bleaching system. In one preferred aspect the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches. In an alternative preferred aspect a preformed organic peroxyacid is incorporated directly into the composition. Compositions containing mixtures of a hydrogen peroxide source and organic peroxyacid precursor in combination with a preformed organic peroxyacid are also envisaged.

Inorganic perhydrate bleaches

The compositions used in this invention preferably include a hydrogen peroxide source, as an oxygen-releasing bleach. Suitable hydrogen peroxide sources include the inorganic perhydrate salts.

The inorganic perhydrate salts are normally incorporated in the form of the sodium salt at a level of from 1% to 40% by weight, more preferably from 2% to 30% by weight and most preferably from 5% to 25% by weight of the compositions.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilise a coated form of the material which provides better storage stability for the perhydrate salt in the granular product.

Sodium perborate can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates for inclusion in compositions in accordance with the invention. Sodium percarbonate is an addition compound having a formula corresponding to $2Na_2CO_3.3H_2O_2$, and is available commercially as a crystalline solid. Sodium percarbonate, being a hydrogen peroxide addition compound tends on dissolution to release the hydrogen peroxide quite rapidly which can increase the tendency for localised high bleach concentrations to arise. The percarbonate is most preferably incorporated into such compositions in a coated form which provides in product stability.

A suitable coating material providing in product stability comprises mixed salt of a water soluble alkali metal sulphate and carbonate. Such coatings together with coating processes have previously been described in GB-1,466,799, granted to Interox on 9th Mar. 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably n is from 0.3 to 1.0 and most preferably n is from 0.2 to 0.5.

Other coatings which contain silicate (alone or with borate salts or boric acids or other inorganics), waxes, oils, fatty soaps can also be used advantageously within the present invention.

Potassium peroxymonopersulfate is another inorganic perhydrate salt of utility in the compositions herein.

Peroxyacid bleach precursor

Peroxyacid bleach precursors are compounds which react with hydrogen peroxide in a perhydrolysis reaction to produce a peroxyacid. Generally peroxyacid bleach precursors may be represented as

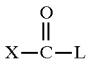

where L is a leaving group and X is essentially any functionality, such that on perhydrolysis the structure of the peroxyacid produced is

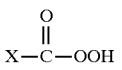

Peroxyacid bleach precursor compounds are preferably incorporated at a level of from 0.5% to 20% by weight, more preferably from 1% to 10% by weight, most preferably from 1.5% to 5% by weight of the compositions.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving groups

The leaving group, hereinafter L group, must be sufficiently reactive for the perhydrolysis reaction to occur within the optimum time frame (e.g., a wash cycle). However, if L is too reactive, this activator will be difficult to stabilise for use in a bleaching composition.

Preferred L groups are selected from the group consisting of:

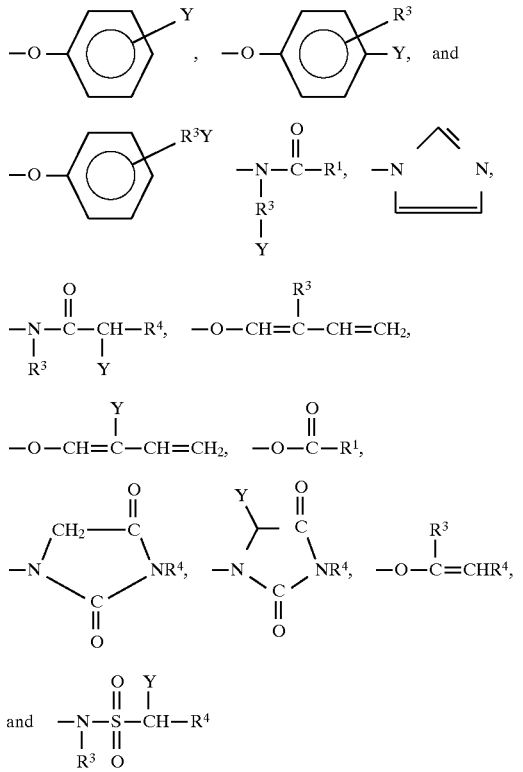

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$. and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$and $O\rightarrow N(R^3)_3$ and most preferably $—SO_3^-M^+$and $—CO_2^-M^+$wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Perbenzoic acid precursor

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

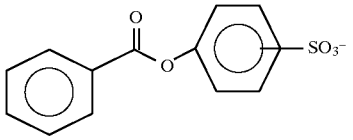

Also suitable are the benzoylation products of sorbitol, glucose, and all saccharides with benzoylating agents, including for example:

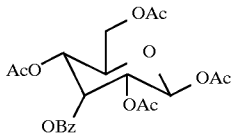

Ac = COCH3; Bz = Benzoyl

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

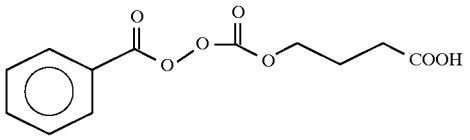

Phthalic anhydride is another suitable perbenzoic acid precursor compound herein:

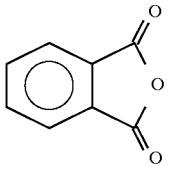

Suitable N-acylated lactam perbenzoic acid precursors have the formula:

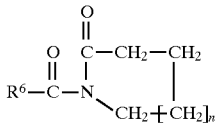

wherein n is from 0 to 8, preferably from 0 to 2, and $R^6$ is a benzoyl group.

Perbenzoic acid derivative precursors

Perbenzoic acid derivative precursors provide substituted perbenzoic acids on perhydrolysis.

Suitable substituted perbenzoic acid derivative precursors include any of the herein disclosed perbenzoic precursors in which the benzoyl group is substituted by essentially any non-positively charged (i.e.; non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

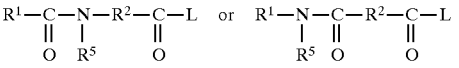

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Cationic peroxyacid precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the compositions as a salt with a suitable anion, such as for example a halide ion or a methylsulfate ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Examples of preferred cationic peroxyacid precursors are described in UK Patent Application No. 9407944.9 and U.S. Pat. Nos. 5,686,015; 5,460,747; 5,578,136; 5,584,888.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

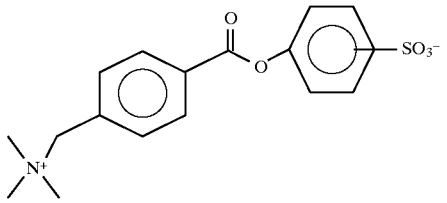

A preferred cationically substituted alkyl oxybenzene sulfonate has the formula:

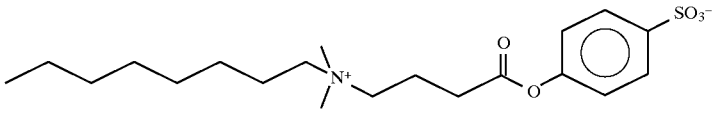

Preferred cationic peroxyacid precursors of the N-acylated caprolactam class include the trialkyl ammonium methylene benzoyl caprolactams, particularly trimethyl ammonium methylene benzoyl caprolactam:

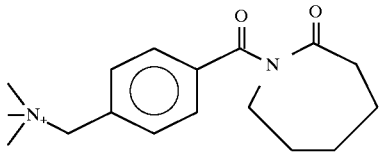

Other preferred cationic peroxyacid precursors of the N-acylated caprolactam class include the trialkyl ammonium methylene alkyl caprolactams:

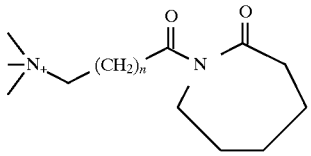

where n is from 0 to 12, particularly from 1 to 5.

Another preferred cationic peroxyacid precursor is 2-(N,N,N-trimethyl ammonium) ethyl sodium 4-sulphophenyl carbonate chloride.

Alkyl percarboxylic acid bleach precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and penta acetyl glucose.

Amide substituted alkyl peroxyacid precursors

Amide substituted alkyl peroxyacid precursor compounds are also suitable, including those of the following general formulae:

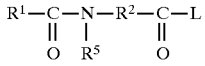

or

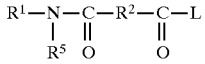

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Benzoxazin organic peroxyacid precursors

Also suitable are precursor compounds of the benzoxazin-type, as disclosed for example in EP-A-332,294 and EP-A-482,807, particularly those having the formula:

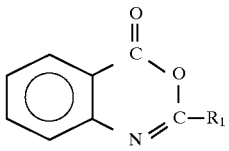

including the substituted benzoxazins of the type

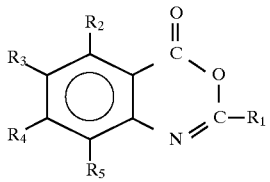

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

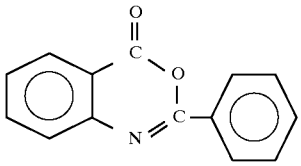

Preformed organic peroxyacid

The organic peroxyacid bleaching system may contain, in addition to, or as an alternative to, an organic peroxyacid bleach precursor compound, a preformed organic peroxyacid , typically at a level of from 0.5% to 25% by weight, more preferably from 1% to 10% by weight of the composition.

A preferred class of organic peroxyacid compounds are the amide substituted compounds of the following general formulae:

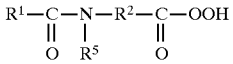

or

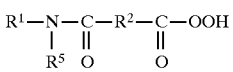

wherein $R^1$ is an alkyl, aryl or alkylaryl group with from 1 to 14 carbon atoms, $R^2$ is an alkylene, arylene, and alkylarylene group containing from 1 to 14 carbon atoms, and $R^5$ is H or an alkyl, aryl, or alkaryl group containing 1 to 10 carbon atoms. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and N-phthaloylaminoperoxicaproic acid are also suitable herein.

Water-soluble bismuth compound

The compositions used in this invention may contain a water-soluble bismuth compound, preferably present at a level of from 0.005% to 20%, more preferably from 0.01% to 5%, most preferably from 0.1% to 1% by weight of the compositions.

The water-soluble bismuth compound may be essentially any salt or complex of bismuth with essentially any inorganic or organic counter anion. Preferred inorganic bismuth salts are selected from the bismuth trihalides, bismuth nitrate and bismuth phosphate. Bismuth acetate and citrate are preferred salts with an organic counter anion.

Water-soluble sulphate salt

In a preferred aspect the compositions contain a water-soluble sulphate salt, preferably present at a level of from 0.1% to 40%, more preferably from 1% to 30%, most preferably from 5% to 25% by weight of the compositions.

The water-soluble sulphate salt may be essentially any salt of sulphate with any counter cation. Preferred salts are selected from the sulphates of the alkali and alkaline earth metals, particularly sodium sulphate.

Additional corrosion inhibitor compound

The compositions may contain additional corrosion inhibitors preferably selected from organic silver coating agents, particularly paraffin, nitrogen-containing corrosion inhibitor compounds and Mn(II) compounds, particularly Mn(II) salts of organic ligands.

Organic silver coating agents are described in PCT Publication No. WO94/16047 and copending UK Application No. UK 9413729.6 (attorney's docket no. CM750F). Nitrogen-containing corrosion inhibitor compounds are disclosed in copending European Application no. EP 93202095.1 (attorney's docket no. CM57 IF). Mn(II) compounds for use in corrosion inhibition are described in copending UK Application No. 9418567.5 (attorney's docket no. CM719FM).

Organic silver coating agents

Organic silver coating agent may be incorporated at a level of from 0.05% to 10%, preferably from 0.1% to 5% by weight of the total composition.

The functional role of the silver coating agent is to form 'in use' a protective coating layer on any silverware components of the washload to which the compositions of the invention are being applied. The silver coating agent should hence have a high affinity for attachment to solid silver surfaces, particularly when present in as a component of an aqueous washing and bleaching solution with which the solid silver surfaces are being treated.

Suitable organic silver coating agents herein include fatty esters of mono- or polyhydric alcohols having from 1 to about 40 carbon atoms in the hydrocarbon chain.

The fatty acid portion of the fatty ester can be obtained from mono- or poly-carboxylic acids having from 1 to about 40 carbon atoms in the hydrocarbon chain. Suitable examples of monocarboxylic fatty acids include behenic acid, stearic acid, oleic acid, palmitic acid, myristic acid, lauric acid, acetic acid, propionic acid, butyric acid, isobutyric acid, valeric acid, lactic acid, glycolic acid and β,β'-dihydroxyisobutyric acid. Examples of suitable polycarboxylic acids include: n-butyl-malonic acid, isocitric acid, citric acid, maleic acid, malic acid and succinic acid.

The fatty alcohol radical in the fatty ester can be represented by mono- or polyhydric alcohols having from 1 to 40 carbon atoms in the hydrocarbon chain. Examples of suitable fatty alcohols include; behenyl, arachidyl, cocoyl, oleyl and lauryl alcohol, ethylene glycol, glycerol, ethanol, isopropanol, vinyl alcohol, diglycerol, xylitol, sucrose, erythritol, pentaerythritol, sorbitol or sorbitan.

Preferably, the fatty acid and/or fatty alcohol group of the fatty ester adjunct material have from 1 to 24 carbon atoms in the alkyl chain.

Preferred fatty esters herein are ethylene glycol, glycerol and sorbitan esters wherein the fatty acid portion of the ester normally comprises a species selected from behenic acid, stearic acid, oleic acid, palmitic acid or myristic acid.

The glycerol esters are also highly preferred. These are the mono-, di- or tri-esters of glycerol and the fatty acids as defined above.

Specific examples of fatty alcohol esters for use herein include: stearyl acetate, palmityl di-lactate, cocoyl isobutyrate, oleyl maleate, oleyl dimaleate , and tallowyl proprionate. Fatty acid esters useful herein include: xylitol monopalmitate, pentaerythritol monostearate, sucrose monostearate, glycerol monostearate, ethylene glycol monostearate, sorbitan esters. Suitable sorbitan esters include sorbitan monostearate, sorbitan palmitate, sorbitan monolaurate, sorbitan monomyristate, sorbitan monobehenate, sorbitan mono-oleate, sorbitan dilaurate, sorbitan distearate, sorbitan dibehenate, sorbitan dioleate, and also mixed tallowalkyl sorbitan mono- and di-esters.

Glycerol monostearate, glycerol mono-oleate, glycerol monopalmitate, glycerol monobehenate, and glycerol distearate are preferred glycerol esters herein.

Suitable organic silver coating agents include triglycerides, mono or diglycerides, and wholly or partially hydrogenated derivatives thereof, and any mixtures thereof. Suitable sources of fatty acid esters include vegetable and fish oils and animal fats. Suitable vegetable oils include soy bean oil, cotton seed oil, castor oil, olive oil, peanut oil, safflower oil, sunflower oil, rapeseed oil, grapeseed oil, palm oil and corn oil.

Waxes, including microcrystalline waxes are suitable organic silver coating agents herein. Preferred waxes have a melting point in the range from about 35° C. to about 110° C. and comprise generally from 12 to 70 carbon atoms. Preferred are petroleum waxes of the paraffin and microcrystalline type which are composed of long-chain saturated hydrocarbon compounds.

Alginates and gelatin are suitable organic silver coating agents herein.

Dialkyl amine oxides such as $C_{12}$–$C_{20}$ methylamine oxide, and dialkyl quaternary ammonium compounds and salts, such as the $C_{12}$–$C_{20}$ methylammonium halides are also suitable.

Other suitable organic silver coating agents include certain polymeric materials. Polyvinylpyrrolidones with an average molecular weight of from 12,000 to 700,000, polyethylene glycols (PEG) with an average molecular weight of from 600 to 10,000, polyamine N-oxide polymers, copolymers of N-vinylpyrrolidone and N-vinylimidazole, and cellulose derivatives such as methylcellulose, carboxymethylcellulose and hydroxyethylcellulose are examples of such polymeric materials.

Certain perfume materials, particularly those demonstrating a high substantivity for metallic surfaces, are also useful as the organic silver coating agents herein.

Nitrogen-containing corrosion inhibitor compounds

Suitable nitrogen-containing corrosion inhibitor compounds include imidazole and derivatives thereof such as benzimidazole, 2-heptadecyl imidazole and those imidazole derivatives described in Czech Patent No. 139, 279 and British Patent GB-A-1,137,741, which also discloses a method for making imidazole compounds.

Also suitable as nitrogen-containing corrosion inhibitor compounds are pyrazole compounds and their derivatives, particularly those where the pyrazole is substituted in any of the 1, 3, 4 or 5 positions by substituents $R_1$, $R_3$, $R_4$ and $R_5$ where $R_1$ is any of H, $CH_2OH$, $CONH_3$, or $COCH_3$, $R_3$ and $R_5$ are any of $C_1$–$C_{20}$ alkyl or hydroxyl, and $R_4$ is any of H, $NH_2$ or $NO_2$.

Other suitable nitrogen-containing corrosion inhibitor compounds include benzotriazole, 2-mercaptobenzothiazole, 1 -phenyl-5-mercapto-1,2,3,4-tetrazole, thionalide, morpholine, melamine, distearylamine, stearoyl stearamide, cyanuric acid, aminotriazole, aminotetrazole and indazole.

Nitrogen-containing compounds such as amines, especially distearylamine and ammonium compounds such as ammonium chloride, ammonium bromide, ammonium sulphate or diammonium hydrogen citrate are also suitable.

Mn(II) corrosion inhibitor compounds

The compositions may contain an Mn(II) corrosion inhibitor compound. The Mn(II) compound is preferably incorporated at a level of from 0.005% to 5% by weight, more preferably from 0.01% to 1%, most preferably from 0.02% to 0.4% by weight of the compositions. Preferably, the Mn(II) compound is incorporated at a level to provide from 0.1 ppm to 250 ppm, more preferably from 0.5 ppm to 50 ppm, most preferably from 1 ppm to 20 ppm by weight of Mn(II) ions in any bleaching solution.

The Mn (II) compound may be an inorganic salt in anhydrous, or any hydrated forms. Suitable salts include manganese sulphate, manganese carbonate, manganese phosphate, manganese nitrate, manganese acetate and manganese chloride. The Mn(II) compound may be a salt or complex of an organic fatty acid such as manganese acetate or manganese stearate.

The Mn(II) compound may be a salt or complex of an organic ligand. In one preferred aspect the organic ligand is a heavy metal ion sequestrant. In another preferred aspect the organic ligand is a crystal growth inhibitor.

Other corrosion inhibitor compounds

Other suitable additional corrosion inhibitor compounds include, mercaptans and diols, especially mercaptans with 4 to 20 carbon atoms including lauryl mercaptan, thiophenol, thionapthol, thionalide and thioanthranol. Also suitable are saturated or unsaturated $C_{10}$–$C_{20}$ fatty acids, or their salts, especially aluminium tristearate. The $C_{12}$–$C_{20}$ hydroxy fatty acids, or their salts, are also suitable. Phosphonated octadecane and other anti-oxidants such as betahydroxytoluene (BHT) are also suitable.

Copolymers of butadiene and maleic acid, particularly those supplied under the trade reference no. 07787 by Polysciences Inc have been found to be of particular utility as corrosion inhibitor compounds.

Water-soluble builder compound

The detergent compositions may contain as a highly preferred component a water-soluble builder compound, typically present at a level of from 1% to 80% by weight, preferably from 10% to 70% by weight, most preferably from 20% to 60% by weight of the composition.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran -tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions can also be used but are not preferred at wash conditions less that about 50° C., especially less than about 40° C.

Examples of carbonate builders are the alkaline earth and alkali metal carbonates, including sodium carbonate and sesqui-carbonate and mixtures thereof with ultra-fine calcium carbonate as disclosed in German Patent Application No. 2,321001 published on Nov. 15, 1973.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially soluble or insoluble builder compound

The compositions of the present invention may less preferably contain a partially soluble or insoluble builder compound. Examples of partially water soluble builders include the crystalline layered silicates as disclosed for example, in EP-A-0 164514, DE-A-3417649 and DE-A-3742043. Examples of largely water insoluble builders include the sodium aluminosilicates, including Zeolite A, Zeolite B, Zeolite P, Zeolite X, Zeolite MAP, Zeolite HS and mixtures thereof.

Alkalinity system

The compositions preferably contain an alkalinity system containing sodium silicate having an $SiO_2$:$Na_2O$ ratio of from 1.8 to 3.0, preferably from 1.8 to 2.4, most preferably 2.0, present preferably at a level of less than 20%, preferably from 1% to 15%, most preferably from 3% to 12% by weight of $SiO_2$. The alkali metal silicate may be in the form of either the anhydrous salt or a hydrated salt.

The alkalinity system also preferably contains sodium metasilicate, present at a level of at least 0.4% $SiO_2$ by weight. Sodium metasilicate has a nominal $SiO_2$:$Na_2O$ ratio of 1.0. The weight ratio of said sodium silicate to said sodium metasilicate, measured as $SiO_2$, is preferably from 50:1 to 5:4, more preferably from 15:1 to 2:1, most preferably from 10:1 to 5:2.

Heavy metal ion sequestrant

The detergent compositions used in this invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates. Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof.

Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof.

Crystal growth inhibitor component

The detergent compositions preferably contain a crystal growth inhibitor component, preferably an organodiphosphonic acid component, incorporated preferably at a level of from 0.01% to 5%, more preferably from 0.1% to 2% by weight of the compositions.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrant components.

The organo diphosphonic acid is preferably a $C_1$–$C_4$ diphosphonic acid, more preferably a $C_2$ diphosphonic acid, such as ethylene diphosphonic acid, or most preferably ethane 1-hydroxy-1,1-diphosphonic acid (HEDP) and may be present in partially or fully ionized form, particularly as a salt or complex.

Enzyme

Another optional ingredient useful in the compositions is one or more enzymes. Preferred enzymatic materials include the commercially available lipases, amylases, neutral and alkaline proteases, esterases, cellulases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of *B licheniformis*, described in more detail in GB-1,269,839 (Novo). Preferred commercially available amylases include for example, those sold under the tradename Rapidase by Gist-Brocades, and those sold under the tradename Termamyl and BAN by Novo Industries A/S. Amylase enzyme may be incorporated into the composition in accordance with the invention at a level of from 0.0001% to 2% active enzyme by weight of the composition.

Lipolytic enzyme (lipase) may be present at levels of active lipolytic enzyme of from 0.0001% to 2% by weight, preferably 0.001% to 1% by weight, most preferably from 0.001% to 0.5% by weight of the compositions. The lipase may be fungal or bacterial in origin. Lipase from chemically or genetically modified mutants of these strains are also useful herein. A preferred lipase is described in Granted European Patent, EP-B-0218272.

An especially preferred lipase herein is obtained by cloning the gene from *Humicola lanuginosa* and expressing the gene in *Aspergillus oryza*, as host, as described in European Patent Application, EP-A-0258 068, which is commercially available from Novo Industries A/S, Bagsvaerd, Denmark, under the trade name Lipolase. This lipase is also described in U.S. Pat. No. 4,810,414, Huge-Jensen et al, issued Mar. 7, 1989.

Enzyme Stabilizing System

Preferred enzyme-containing compositions herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, chlorine bleach scavengers and mixtures thereof. Such stabilizing systems can also comprise reversible enzyme inhibitors, such as reversible protease inhibitors.

Organic polymeric compound

Organic polymeric compounds may be added as preferred components of the compositions. By organic polymeric compound it is meant essentially any polymeric organic compound commonly used as dispersants, and anti-redeposition and soil suspension agents in detergent compositions. Organic polymeric compounds have not previously been described as dye transfer inhibitors.

Organic polymeric compound is typically incorporated in the detergent compositions of the invention at a level of from 0.1% to 30%, preferably from 0.5% to 15%, most preferably from 1% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of molecular weight 2000–10000 and their copolymers with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Preferred are the copolymers of acrylic acid and maleic anhydride having a molecular weight of from 20,000 to 100,000.

Preferred commercially available acrylic acid containing polymers having a molecular weight below 15,000 include those sold under the tradename Sokalan PA30, PA20, PA 15, PA10 and Sokalan CP10 by BASF GmbH, and those sold under the tradename Acusol 45N by Rohm and Haas.

Preferred acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula $—[CR_2—CR_1(CO—O—R_3)]—$ wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a molecular weight of 3500 and contains 60% to 80% by weight of acrylic acid and 40% to 20% by weight of methacrylic acid.

The polyamino compounds are useful herein including those derived from aspartic acid such as those disclosed in EP-A-305282, EP-A-305283 and EP-A-351629.

Lime soap dispersant compound

The compositions may contain a lime soap dispersant compound, preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. Preferred lime soap dispersant compounds are disclosed in PCT Application No. WO93/08877 (attorney's docket no. CM466M).

Suds suppressing system

The compositions, when formulated for use in machine washing compositions, preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl and alcanol antifoam compounds. Preferred suds suppressing systems and antifoam compounds are disclosed in PCT Application No. WO93/08876 (attorney's docket no. CM465M) and copending European Application No. 93870132.3 (attorney's docket no. CM562F).

pH of the compositions

The detergent compositions used in the present invention are preferably not formulated to have an unduly high pH, in preference having a pH measured as a 1% solution in distilled water of from 8.0 to 12.0, more preferably from 9.0 to 11.8, most preferably from 9.5 to 11.5.

Form of the compositions

The detergent compositions can be formulated in any desirable form such as powders, granulates, pastes, liquids, gels and tablets, granular forms being preferred.

The bulk density of the granular detergent compositions in accordance with the present invention is typically of at least 650 g/liter, more usually at least 700 g/liter and more preferably from 800 g/liter to 1200 g/liter.

The particle size of the components of granular compositions in accordance with the invention should preferably be such that no more that 5% of particles are greater than 1.4 mm in diameter and not more than 5% of particles are less than 0.15 mm in diameter.

Generally, if the compositions are in liquid form the liquid should be thixotropic (ie; exhibit high viscosity when subjected to low stress and lower viscosity when subjected to high stress), or at least have very high viscosity, for example, of from 1,000 to 10,000,000 centipoise.

EXAMPLES

The following examples illustrate the present invention.

In the compositions, the abbreviated component identifications have the following meanings:

| | |
|---|---|
| Nonionic: | $C_{13}$—$C_{15}$ mixed ethoxylated/propoxylated fatty alcohol with an average degree of ethoxylation of 3.8 and an average degree of propoxylation of 4.5 sold under the tradename Plurafac LF404 by BASF GmbH (low foaming) |
| Metasilicate: | Sodium metasilicate ($SiO_2$:$Na_2O$ ratio = 1.0) |
| Silicate: | Amorphous Sodium Silicate ($SiO_2$:$Na_2O$ ratio = 2.0) |
| Carbonate: | Anhydrous sodium carbonate |
| Phosphate: | Sodium tripolyphosphate |
| 480N: | Random copolymer of 3:7 acrylic/methacrylic acid, average molecular weight about 3,500 |
| Citrate: | Tri-sodium citrate dihydrate |
| PB1: | Anhydrous sodium perborate monohydrate |
| CMC: | Carboxy Methyl Cellulose (66% active) |
| Methyl cellulose: | Methyl cellulose of molecular weight 50,000 |
| TAED: | Tetraacetyl ethylene diamine |
| Cationic precursor | Cationic peroxyacid bleach precursor salt of trialkyl ammonium methylene $C_5$-alkyl caprolactam with tosylate |
| BzP: | Dibenzoyl peroxide |
| DETPMP: | Diethylene triamine penta (methylene phosphonic acid), marketed by Monsanto under the tradename Dequest 2060 |
| HEDP: | Ethane 1-hydroxy-1,1-diphosphonic acid |
| PMT: | 1-phenyl-5-mercapto-1,2,3,4-tetrazole |
| Bismuth nitrate: | Bismuth nitrate salt |
| Paraffin: | Paraffin oil sold under the tradename Winog 70 by Wintershall. |
| BD/MA: | Copolymer of butadiene/maleic acid as sold by Polysciences inc under the tradename reference no. 07787 |
| Protease: | Proteolytic enzyme sold under the tradename Savinase by Novo Industries A/S (approx. 2% enzyme activity). |
| Amylase: | Amylolytic enzyme sold under the tradename Termamyl 60T by Novo Industries A/S (approx. 0.9% enzyme activity) |
| BSA: | Amylolytic enzyme sold under the tradename LE17 by Novo Industries A/S (approx. 1% enzyme activity) |
| Sulphate: | Anhydrous sodium sulphate. |
| pH: | Measured as a 1% solution in distilled water at 20° C. |

In the following examples all levels of enzyme quoted are expressed as % active enzyme by weight of the composition.

The following cellulose ether-containing machine dishwashing compositions were prepared (parts by weight). Compositions A is a comparative composition, compositions B to G are in accord with the invention.

| | A | B | C | D | E | F | G |
|---|---|---|---|---|---|---|---|
| Citrate | 15.0 | 15.0 | 15.0 | 15.0 | 15.0 | 15.0 | — |
| 480N | 6.0 | 6.0 | 6.0 | 6.0 | 6.0 | 6.0 | — |
| Carbonate | 17.5 | 17.5 | 17.5 | 17.5 | 17.5 | 17.5 | — |
| Phosphate | — | — | — | — | — | — | 38.0 |
| Silicate (as $SiO_2$) | 8.0 | 8.0 | 8.0 | 8.0 | 8.0 | 8.0 | 14.0 |
| Metasilicate (as $SiO_2$) | 1.2 | 1.2 | 1.2 | 1.2 | 1.2 | 1.2 | 2.5 |
| CMC | — | — | 0.6 | 2.0 | 1.2 | 1.2 | 1.2 |
| Methyl cellulose | — | 1.2 | — | — | — | — | — |
| PB1 (AvO) | 1.2 | 1.2 | 1.5 | 1.5 | 1.5 | 2.2 | 1.2 |
| TAED | 2.2 | 2.2 | 2.2 | — | — | 2.2 | 2.2 |
| Cationic precursor | — | — | — | — | 3.3 | — | — |
| Paraffin | 0.5 | 0.5 | 0.5 | 0.5 | 0.5 | 0.5 | 0.5 |
| Bismuth nitrate | 0.2 | 0.2 | 0.2 | 0.2 | 0.3 | 0.4 | 0.2 |
| BD/MA | — | — | — | — | — | — | 0.5 |
| PMT | — | — | — | — | — | — | 0.5 |
| Protease | 0.04 | 0.04 | 0.04 | 0.04 | 0.04 | 0.04 | 0.04 |
| Amylase | 0.03 | 0.03 | 0.03 | 0.03 | 0.06 | 0.01 | — |
| BSA | — | — | — | — | — | — | 0.03 |
| DETPMP | 0.13 | 0.13 | 0.13 | 0.13 | 0.13 | 0.13 | — |
| HEDP | 1.0 | 1.0 | 1.0 | 1.0 | 1.0 | 1.0 | — |
| Nonionic | 2.0 | 2.0 | 2.0 | 2.0 | 2.0 | 2.0 | 1.5 |
| Sulphate | 23.0 | 22.8 | 22.4 | 22.7 | 22.2 | 21.5 | 0.3 |
| misc inc moisture to balance | | | | | | | |
| pH (1% solution) | 10.7 | 10.7 | 10.7 | 10.7 | 10.7 | 10.7 | 11.0 |

Test method 1

The ability of Compositions A to B to prevent the transfer of coloured food soils to a plastic substrate was assessed using the following representative test method.

1. A representative coloured food soil containing carotenoid type soils was prepared by liquidising equal quantities by weight of baked beans in tomato sauce, pasta sauce ("Ragu" tradename), Tandoori marinade and blackcurrant jam.
2. Polypropylene plastic test samples (small container lid of 7 cm in diameter; small lunch box 15 cm×10 cm; large lunch box 20 cm×15 cm) were washed in a Hotpoint 7883 (tradename) dishwashing machine, economy cycle at 55° C., using an aqueous wash solution containing 0.0035% by weight active methyl cellulose and 0.5% by weight of the representative coloured food soil in 5 liters of wash water. The water was at a hardness of 9 grains per gallon (equivalent to 1.26 mmol $Ca^2$+/liter).
3. Each of the plastic test samples was subjected to 7 consecutive wash cycles so as to increase the likelihood of the plastic test samples becoming soiled with the coloured food soil. The plastic test samples were then removed, dried and visually graded for staining using a light intensity meter sold under the tradename x-rite colour difference meter and made by Spectrotech. The higher the reading obtained the more intense the colour.

Test method 1—results

The presence of coloured food soil staining apparent on the plastic samples obtained using detergent composition B was compared to that obtained for the reference (composition A).

| Test Sample | Composition A | Composition B |
|---|---|---|
| Small container lid; 7 cm diameter | 19.5 | 11.5 |
| Small lunch box; 15 cm × 10 cm | 13.8 | 2.9 |
| Large lunch box; 20 cm × 15 cm | 8.7 | 3.0 |

The degree of staining obtained when using composition B in accord with the invention was less that obtained for the reference composition A.

What is claimed is:

1. A method for inhibiting the transfer of colored food soil from an aqueous wash solution to a substrate, comprising the step of washing the substrate with a dishwashing composition comprising an amount of cellulose ether such that the cellulose ether is present in the aqueous wash solution at a level of from between 0.0001% to 0.1% and 0.005% to 20% by weight of a water-soluble bismuth compound.

2. A method according to claim 1, wherein the dishwashing composition further comprises from 0.2% to 30%, by weight, surfactant.

3. A method according to claim 1, wherein the method is a machine dishwashing method.

4. A method according to claim 1, wherein the cellulose ether has the formula:

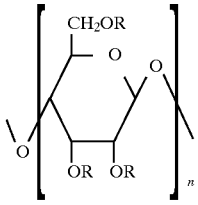

wherein R is a hydrogen, an alkyl or a carboxy alkyl group; and n is 100 to 10,000; and further wherein the cellulose ether has a degree of substitution of between 0 and 3.0, a degree of polymerization of more than 100, and a molecular weight of between 20,000 and 150,000.

5. A method according to claim 4, wherein the cellulose ether is selected from the group consisting of methyl cellulose, carboxy methyl cellulose and mixtures thereof.

6. A method according to claim 1, wherein the colored food soil is a carotenoid soil.

7. A method according to claim 1, wherein the substrate comprises plastic material.

8. A dishwashing method according to claim 1, wherein the dishwashing composition further comprises from 0.5% to 25%, by weight, of a pre-formed organic peroxyacid.

9. A method according to claim 1, wherein the dishwashing composition further comprises:

(i) from 1% to 40%, by weight, of an inorganic perhydrate salt; and (ii) from 0.5% to 20%, by weight, of an organic peroxyacid bleach precursor selected from the group consisting of:

precursors of unsubstituted perbenzoic acid;

precursors of substituted perbenzoic acid wherein the perbenzoic acid is substituted with a non-cationic functional group selected from the group consisting of alkyls, hydroxy, alkoxys, halogens, amines, nitrosyls, and amides;

precursors of substituted perbenzoic acid wherein the perbenzoic acid is substituted with a cationic functional group selected from the group consisting of ammonium, and alkyl ammoniums;

unsubstituted alkyl percarboxylic acid precursors;

amide substituted alkyl peroxyacid acid precursors;

benzoxazin organic peroxyacid precursors; and mixtures thereof.

10. A method according to claim 9, wherein the aqueous wash solution comprises, by weight, from 0.05% to 2% of the dishwashing composition.

11. A method for inhibiting the transfer of colored food soil from an aqueous wash solution to a substrate, comprising the step of washing the substrate with a dishwashing composition comprising:

(a) an amount of cellulose ether such that the cellulose ether is present in the aqueous wash solution at a level of from between 0.0001% and 0.1%;

(b) a hydrogen peroxide source;

(c) a member selected from the group consisting of organic peroxyacid bleach precursors, pre-formed organic peroxyacids, and mixtures thereof; and (d) 0.005% to 20% by weight, of a water-soluble bismuth compound selected from the group consisting of bismuth trihalides, bismuth nitrate, bismuth phosphate, complexes of bismuth acetate with an organic counter anion, complexes of bismuth citrate with an organic counter anion, and mixtures thereof.

12. A method according to claim 11, wherein the pre-formed organic peroxyacid is selected from the group consisting of:

compounds having the structure:

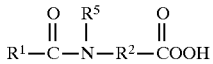

wherein $R^1$ is an alkyl, aryl, or alkylaryl group containing from 1 to 14 carbon atoms, $R^2$ is an alkylene, arylene, or alkylarylene group containing from 1 to 14 carbon atoms, and $R^5$ is H or an alkyl, aryl or alkylaryl group containing from 1 to 10 carbon atoms;

compounds having the structure:

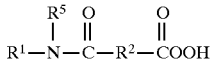

wherein $R^1$ is an alkyl, aryl, or alkylaryl group containing from 1 to 14 carbon atoms, $R^2$ is an alkylene, arylene, or alkylarylene group containing from 1 to 14 carbon atoms, and $R^5$ is H or an alkyl, aryl or alkylaryl group containing from 1 to 10 carbon atoms;

diacylperoxides;

tetraacylperoxides;

dibenzoyl peroxide;

monoperazelaic acid;

diperazelaic acid;

monoperbrassylic acid;

diperbrassylic acid; and

N-phthaloylaminoperoxicaproic acid.

13. A method according to claim 11, wherein the organic peroxyacid bleach precursor is selected from the group consisting of:

precursors of unsubstituted perbenzoic acid;

precursors of substituted perbenzoic acid wherein the perbenzoic acid is substituted with a non-cationic functional group selected from the group consisting of alkyls, hydroxy, alkoxys, halogens, aimines, nitrosyls, and amides;

precursors of substituted perbenzoic acid wherein the perbenzoic acid is substituted with a cationic functional group selected from the group consisting of ammonium, and alkyl ammoniums;

unsubstituted alkyl percarboxylic acid precursors;

amide substituted alkyl peroxyacid acid precursors;

benzoxazin organic peroxyacid precursors; and mixtures thereof.

14. A method according to claim 11, wherein the hydrogen peroxide source comprises a perhydrate salt and further wherein the dishwashing composition comprises:

(a) an amount of the cellulose ether such that the cellulose ether is present in the aqueous wash solution at a level of from between 0.0001% to 0.1%;

(b) from 1% to 40%, by weight, of the perhydrate salt;

(c) from 1% to 10%, by weight, of the member selected from the group consisting of organic peroxyacid bleach precursor, pre-formed organic peroxyacids, and mixtures thereof, and (d) from 0.005% to 20% by weight, of the water-soluble bismuth compound.

15. A method according to claim 11, wherein the dishwashing composition further comprises sodium silicate and sodium metasilicate.

16. A dishwashing method according to claim 11, wherein the cellulose ether has the formula:

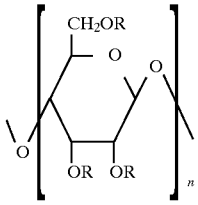

wherein R is a hydrogen, an alkyl or a carboxy alkyl group; and n is 100 to 10,000; and further wherein the cellulose ether has a degree of substitution of between 0 and 3.0, a degree of polymerization of more than 100, and a molecular weight of between 20,000 and 150,000.

17. A method according to claim 11, wherein the dishwashing composition further comprises a corrosion inhibitor selected from the group consisting of nitrogen-containing corrosion inhibitors, $Mn^{2+}$ compounds, and mixtures thereof.

18. A method for inhibiting the transfer of colored food soil from an aqueous wash solution to a substrate, comprising the step of washing the substrate with a dishwashing composition comprising:

(a) cellulose ether in an amount such that the cellulose ether is present in the aqueous wash solution at a level of from between 0.0001% to 1%;

(b) from 5% to 25%, by weight, inorganic perhydrate salt;

(c) from 0.01% to 5%, by weight, water-soluble bismuth compound; and (d) from 1% to 5%, by weight, surfactant.

19. A method according to claim 18, wherein the dishwashing composition further comprises from 0.1% to 40%, by weight, water-soluble sulfate salt.

20. A method according to claim 19, wherein the dishwashing composition further comprises from 0.05% to 10%, by weight, of an organic silver coating agent selected from the group consisting of fatty esters of mono-alcohols, fatty esters of di-alcohols, waxes, alginates, gelatin, dialkyl amine oxides, polyvinylpyrrolidones, polyethylene glycols, polyamine N-oxide polymers, copolymers of N-vinylpyrrolidone and N-vinylimidazole, and mixtures thereof.

21. A method according to claim 18, wherein the dishwashing composition further comprises a $Mn^{2+}$ compound at a level sufficient to provide the aqueous wash solution with a $Mn^{2+}$ level of from 0.1 ppm to 250 ppm.

22. A method according to claim 18, wherein the dishwashing composition further comprises from 0.005% to 20%, by weight, of a heavy metal ion sequesterant selected from the group consisting of ethylenediamine-N,N'-disuccinic acid, alkali metal salts of ethylenediamine-N,N'-disuccinic acid, alkaline earth metal salts of ethylenediamine-N,N'-disuccinic acid, ammonium salts of ethylenediamine-N,N'-disuccinic acid, substituted ammonium salts of ethylenediamine-N,N'-disuccinic acid, and mixture thereof.

23. A method according to claim 18, wherein the dishwashing composition further comprises from 0.01% to 5% of a crystal growth inhibitor selected from the group consisting of organo diphosphonic acids, salts of organo diphosphonic acids and mixtures thereof.

24. A method according to claim 18, wherein the aqueous wash solution comprises, by weight, from 0.05% to 2% of the dishwashing composition.

25. A method according to claim 18, wherein the dishwashing composition has a pH measured as a 1% solution in distilled water of from 8.0 to 12.0.

* * * * *